US010172441B2

(12) United States Patent
Wu et al.

(10) Patent No.: US 10,172,441 B2
(45) Date of Patent: Jan. 8, 2019

(54) ORAL CARE IMPLEMENT

(71) Applicant: COLGATE-PALMOLIVE COMPANY, New York, NY (US)

(72) Inventors: Donghui Wu, Bridgewater, NJ (US); Alan Sorrentino, Cranbury, NJ (US); Robert Moskovich, East Brunswick, NJ (US); Eduardo Jimenez, Manalapan, NJ (US); Kenneth Waguespack, North Brunswick, NJ (US); Douglas Joseph Hohlbein, Hopewell, NJ (US); Matthew Lee Kolb, Upper Black Eddy, PA (US); Paul Donald Carse, Milford, NJ (US)

(73) Assignee: Colgate-Palmolive Company, New York, NY (US)

( * ) Notice: Subject to any disclaimer, the term of this patent is extended or adjusted under 35 U.S.C. 154(b) by 159 days.

(21) Appl. No.: 15/309,191

(22) PCT Filed: May 7, 2014

(86) PCT No.: PCT/US2014/037142
§ 371 (c)(1),
(2) Date: Nov. 6, 2016

(87) PCT Pub. No.: WO2015/171131
PCT Pub. Date: Nov. 12, 2015

(65) Prior Publication Data

US 2017/0079419 A1 Mar. 23, 2017

(51) Int. Cl.
*A46B 11/00* (2006.01)
*A46B 5/00* (2006.01)
(Continued)

(52) U.S. Cl.
CPC ..... *A46B 11/0006* (2013.01); *A46B 5/0095* (2013.01); *A46B 5/021* (2013.01);
(Continued)

(58) Field of Classification Search
CPC ... A46B 11/0006; A46B 11/00; A46B 11/002; A46B 11/0041; A46B 11/0024;
(Continued)

(56) References Cited

U.S. PATENT DOCUMENTS 2,743,042 A 6/1953 Burgin
2,652,949 A 9/1953 Martin
(Continued)

FOREIGN PATENT DOCUMENTS

CN 1267198 A 9/2000
CN 2357578 2/2012
(Continued)

OTHER PUBLICATIONS

International Search Report and the Written Opinion of the International Searching Authority issued in international application PCT/2014/037135 dated Jan. 22, 2015.

*Primary Examiner* — David Walczak

(57) ABSTRACT

An oral care implement having a body comprising a handle and a head, the body having a cavity, and the head having at least one oral care element extending therefrom; a movable wall in the cavity that divides the cavity into first and second reservoirs, the first reservoir for storing an oral care fluid; a fluid outlet through which the oral care fluid is dispensable to an exterior of the oral care implement; a passageway fluidly connecting the first reservoir with the fluid outlet; a control valve movable between a first position and a second position for preventing and permitting fluid flow from the first reservoir, respectively; a first opening fluidly connecting the second reservoir with the exterior of the oral care
(Continued)

implement; and a first check valve for permitting and restricting air flow into and out of the second reservoir from the exterior.

20 Claims, 2 Drawing Sheets

(51) Int. Cl.
*A46B 5/02* (2006.01)
*A46B 9/04* (2006.01)

(52) U.S. Cl.
CPC ..... *A46B 5/026* (2013.01); *A46B 9/04* (2013.01); *A46B 11/002* (2013.01); *A46B 11/0041* (2013.01); *A46B 11/0058* (2013.01); *A46B 11/0086* (2013.01); *A46B 2200/1066* (2013.01)

(58) Field of Classification Search
CPC ..... A46B 11/0037; A46B 11/0058; A46B 11/0062; A46B 11/0065; A46B 11/0068; A46B 5/0095; A46B 5/00; A46B 5/021; A46B 5/026; A46B 9/004; A46B 2200/1066; A46B 11/0086
See application file for complete search history.

(56) References Cited

U.S. PATENT DOCUMENTS

| | | | | |
|---|---|---|---|---|
| 3,256,894 | A | 6/1966 | Sherman | |
| 3,400,996 | A * | 9/1968 | Vandergrift ..... | A46B 11/0055 401/143 |
| 4,124,316 | A | 11/1978 | Rourke | |
| 4,155,663 | A | 5/1979 | Cerquozzi | |
| 4,521,128 | A | 6/1985 | O'Neal | |
| 4,582,075 | A | 4/1986 | O'Neal | |
| 4,615,635 | A | 10/1986 | Kim | |
| 4,963,046 | A | 10/1990 | Eguchi | |
| 5,393,153 | A | 2/1995 | Bouthillier | |
| 5,918,995 | A | 7/1999 | Puurunen | |
| 6,056,466 | A | 5/2000 | Johnson | |
| 6,206,600 | B1 | 3/2001 | Rosenberg et al. | |
| 6,257,791 | B1 | 7/2001 | Scamard | |
| 6,406,207 | B1 * | 6/2002 | Wiegner ..... | A46B 11/0027 222/207 |
| 7,004,662 | B1 | 2/2006 | Gordon | |
| 7,021,851 | B1 * | 4/2006 | King ..... | A46B 11/0024 401/186 |
| 9,022,680 | B1 * | 5/2015 | Lubyanitskiy ..... | A46B 11/0086 401/142 |
| 2007/0041779 | A1 | 2/2007 | Kuo | |
| 2007/0086831 | A1 | 4/2007 | Wold | |
| 2012/0301209 | A1 | 11/2012 | Fattori | |
| 2013/0308994 | A1 | 11/2013 | Wu | |

FOREIGN PATENT DOCUMENTS

| | | |
|---|---|---|
| CN | 2471197 | 5/2012 |
| FR | 2600513 | 12/1987 |
| GB | 913371 | 12/1962 |
| GB | 2290702 | 1/1996 |
| GB | 2291799 | 2/1996 |
| GB | 2329110 | 3/1999 |

* cited by examiner

ORAL CARE IMPLEMENT

BACKGROUND

The present invention relates to an oral care implement, such as a toothbrush, having an oral care fluid dispensing mechanism.

It is known to provide an oral care implement, such as a toothbrush, with a reservoir storing an oral care fluid that is feedable to a fluid outlet at a head of the implement. One such known oral care implement has a pump mechanism for dispensing the oral care fluid that requires repeated actuation during dispensing in order to dispense a volume of the oral care fluid sufficient for the user to benefit from the effects of the oral care fluid. Since the dispensing is carried out while the oral care implement is held aloft with the fluid outlet within the user's oral cavity, such repeated actuation of the pump mechanism during dispensing can be tiresome and uncomfortable for the user.

There is a need for an oral care implement having an oral care fluid dispensing mechanism that is less tiresome and uncomfortable to operate during dispensing.

BRIEF SUMMARY

An embodiment of the present invention provides an oral care implement, comprising: a body comprising a handle and a head at an end of the handle, the body having a cavity therein, and the head having at least one oral care element extending therefrom; a movable wall in the cavity, the wall dividing the cavity into first and second reservoirs of variable volume, the first reservoir being for storing an oral care fluid; a fluid outlet through which the oral care fluid is dispensable to an exterior of the oral care implement; a passageway fluidly connecting the first reservoir with the fluid outlet; a control valve movable between a first position for preventing fluid flow from the first reservoir through the fluid outlet and a second position for permitting fluid flow from the first reservoir through the fluid outlet; a first opening fluidly connecting the second reservoir with the exterior of the oral care implement; and a first check valve for permitting air flow into the second reservoir from the exterior of the oral care implement via the first opening and for restricting air flow from the second reservoir to the exterior of the oral care implement via the first opening.

Optionally, the wall comprises a piston.

Optionally, the wall comprises a deformable vessel surrounding the first reservoir, and the vessel has an orifice in fluid communication with the passageway.

Optionally, the vessel is deformable according to a predetermined pattern of collapse.

Optionally, the vessel comprises a bellows.

Optionally, at least a portion of the second reservoir surrounds the first reservoir.

Optionally, the oral care implement comprises a pump comprising a chamber and a second opening fluidly connecting the chamber with the exterior of the oral care implement, wherein the chamber is fluidly connected with the second reservoir via the first opening. Further optionally, the chamber is of variable volume, and the pump is operable to reduce the volume of the chamber when the second opening is blocked, thereby to push air from the chamber into the second reservoir via the first opening. Still further optionally, the pump comprises flexible material defining the chamber.

Optionally, the pump comprises a second check valve for permitting air flow into the chamber from the exterior of the oral care implement via the second opening and for restricting air flow from the chamber to the exterior of the oral care implement via the second opening.

Optionally, the pump is at an opposite end of the handle from the head.

Optionally, the head defines the fluid outlet.

Optionally, the cavity is in the handle.

Optionally, the cavity is of fixed volume. Alternatively, the cavity is of variable volume. The handle may define the cavity and be compressible to reduce the volume of the cavity.

Optionally, the oral care implement comprises a third check valve in the passageway for permitting fluid flow from the first reservoir towards the fluid outlet and for restricting fluid flow from the fluid outlet towards the first reservoir.

Optionally, the control valve is in the handle.

Optionally, when the control valve is at the first position, the control valve blocks the passageway.

Optionally, the oral care implement comprises a biasing device that biases the control valve towards the first position.

Optionally, the oral care fluid is stored in the first reservoir.

Optionally, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof Optionally, the oral care implement comprises a toothbrush.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the following description, each of the exemplary embodiments of the oral care implement of the invention comprises a manually-operated oral care implement, more specifically a manually-operated toothbrush. However, in variations to these embodiments, the oral care implement could instead comprise a powered oral care implement, such as a powered toothbrush, wherein one or more oral care elements provided to the head of the implement are drivable so as to be moved relative to the handle of the implement. In still further embodiments, the oral care implement could instead comprise other forms of oral care implement, such as a soft-tissue cleaner, a tooth polisher, an interdental brush, a tongue scraper, or another implement designed for oral care. It is to be understood that other embodiments may be utilised, and that structural and functional modifications may be made without departing from the scope of the present invention.

Figure 1:
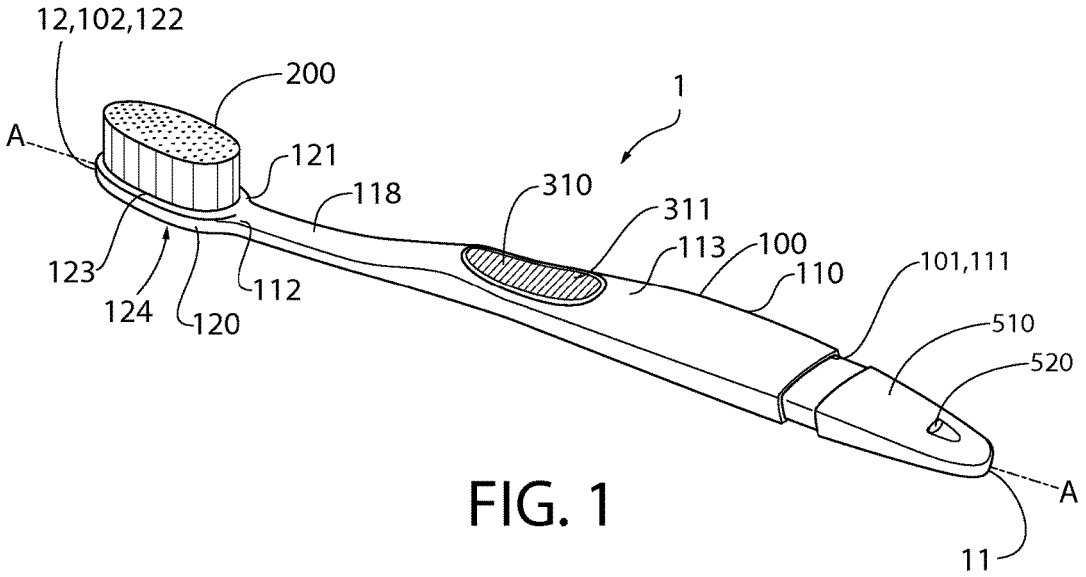
FIG. 1 shows a perspective view of an oral care implement according to an exemplary embodiment of the present invention.
Figure 2:
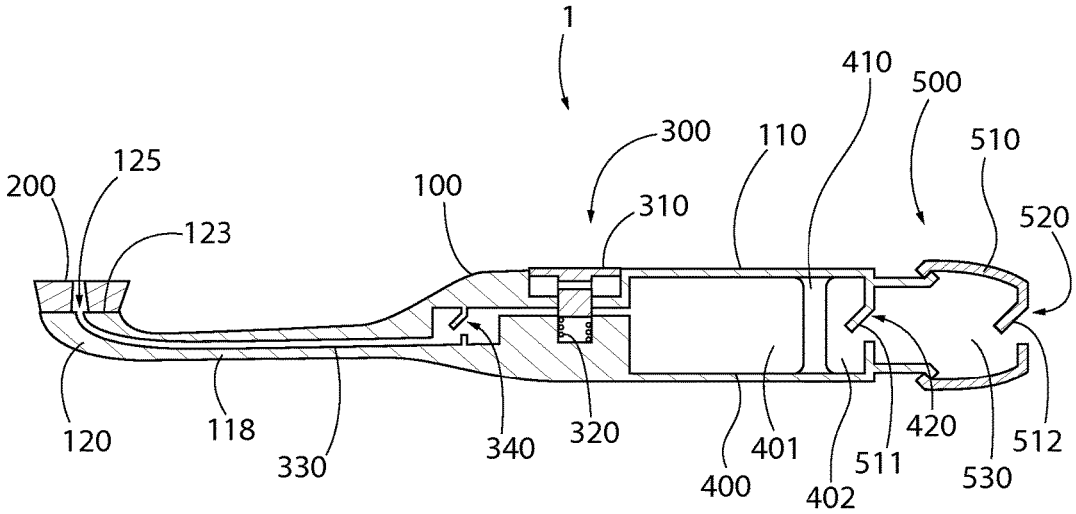
FIG. 2 shows a schematic diagram of the oral care implement of FIG. 1.

FIGS. 1 and 2 illustrate an oral care implement, in this case a toothbrush, according to an exemplary embodiment of the present invention, generally designated with the reference numeral 1. As viewed from the exterior, the toothbrush 1 generally comprises a body 100, oral care elements 200 and a fluid outlet 125 on a head 120 of the body 100, a user-operable pump actuator 510 of a pump 500 at a proximal end 111 of a handle 110 of the body 100, and a thumb grip surface 311 of a user-operable valve actuator 310 of a control valve 300 on the handle 110.

The toothbrush 1 has a proximal end 11 and a distal end 12 and is elongate between the proximal and distal ends 11, 12. Moreover, the body 100 of the toothbrush 1 has a proximal end 101 and a distal end 102 and is elongate between the proximal and distal ends 101, 102 of the body 100. The body 100 comprises the handle 110 and the head 120 at a distal end 112 of the handle 110. The head 120 is a distal portion of the body 100 and has a proximal end 121 and a distal end 122, which distal end 122 forms the distal end 102 of the body 100 and the distal end 12 of the toothbrush 1. The head 120 has extending therefrom the oral care elements 200 for cleaning or polishing surfaces in a user's mouth, such as surfaces of their teeth.

The oral care elements 200 extend from a first, front side of the toothbrush 1, more specifically from a first, front side 123 of the head 120, and are for cleaning or polishing surfaces in a user's mouth, such as surfaces of their teeth. As used herein, the term "oral care element" is used in a generic sense to refer to any structure that can be used to clean, massage or polish an oral surface, such as teeth or soft tissue, through relative surface contact. In this embodiment, the oral care elements comprise a plurality of tooth cleaning elements, preferably a plurality of flexible bristles arranged in tufts. However, in variations to this embodiment, the oral care elements may additionally or alternatively comprise one or more tooth polishing elements, preferably in the form of elastomeric tooth polishing elements, such as elastomeric protrusions, elements, fingers, or prophylactic (prophy) cups. In some embodiments, the oral care elements 200 may comprise at least one of any one or more of the following, without limitation: bristles, rigid bristles, flexible bristles, filament bristles, fibre bristles, nylon bristles, polybutylene terephthalate (PBT) bristles, tapered bristles, spiral bristles, rubber bristles, elastomeric protrusions, elastomeric elements, flexible polymer protrusions, co-extruded filaments, flag bristles, crimped bristles, anti-bacterial bristles and combinations thereof and/or structures containing such materials or combinations. The head 120 also comprises or defines the fluid outlet 125 at the first, front side 123 of the head 120. The fluid outlet 125 will be described in more detail below.

In a variation to the illustrated embodiment, a soft tissue cleaner may be provided on a second side of the toothbrush 1, such as a second, rear side of the toothbrush 1 opposite to the front side of the toothbrush 1. Such a soft tissue cleaner may be provided on a second, rear side 124 of the head 120.

The handle 110 is a proximal portion of the body 100 and has the distal end 112 and the proximal end 111, which proximal end 111 forms the proximal end 101 of the body 100. The handle 110 includes a neck portion 118 by which the handle 110 is connected with the head 120. The neck portion 118 is generally of a smaller cross sectional area than the rest of the handle 110. The neck portion 118 includes the distal end 112 of the handle 110, which is that portion of the handle 110 fixed to and closest to the proximal end 121 of the head 120. In the illustrated embodiment, the head 120 is non-detachable from the handle 110. However, in variations to the illustrated embodiment, the head 120 may be detachable from the handle 110, such as for replacement of the head 120 when the oral care elements 200 become worn.

The handle 110 provides a user with a mechanism by which he/she can readily grip and manipulate the toothbrush 1, includes ergonomic features which provide a high degree of control for the user while maintaining comfort, and may be formed of many different shapes and with a variety of constructions. Although the handle 110 is a non-linear structure in the illustrated embodiment, the invention is not so limited, and in certain embodiments the toothbrush 1 may have a simple linear handle 110. In the illustrated embodiment, the toothbrush 1 comprises the thumb grip surface 311 on the first, front side of the toothbrush 1, more specifically on a first, front side 113 of the handle 110. On a second, rear side of the toothbrush 1, more specifically on a second, rear side of the handle 110, the toothbrush 1 may comprise a second grip surface. During use of the toothbrush 1, a user most comfortably holds the toothbrush 1 with the handle 110 lying in the palm of their hand, with their thumb on the thumb grip surface 311, and with their index and/or middle finger on the second grip surface.

As shown in FIG. 2, the toothbrush 1 comprises a cavity 400 in the handle 110 of the body 100. In the illustrated embodiment, the cavity 400 is comprised in a substantially rigid vessel formed from a plastic, such as a thermoplastic polymer, e.g. polyethylene terephthalate (PET) or polypropylene (PP), so that the cavity 400 is of substantially fixed volume. The cavity 400 is housed inside the body 100 of the toothbrush 1, and is not visible from the exterior of the toothbrush 1. However, in variations to the illustrated embodiment, the cavity 400 is comprised in a vessel made of transparent or translucent material and one or more windows are provided in the body 100, so that the cavity 400 and its contents are visible from the exterior of the toothbrush 1. In further embodiments, the vessel comprising the cavity 400 is comprised in the body 100, and the vessel comprising the cavity 400 forms at least part of the handle 110. In some embodiments, the reservoir 400 is the handle 110. In some embodiments, the vessel comprising the cavity 400 is detachably connected to the body 100 and may be replaceable or disposable.

Inside the cavity 400 is a movable wall in the form of a piston 410, which divides the cavity 400 into first and second reservoirs 401, 402 of variable volume. That is, the piston 410 isolates the first reservoir 401 from the second reservoir 402. The first reservoir 401 stores an oral care fluid, and the second reservoir 402 is for pre-pressurizing the oral care fluid in the first reservoir 401, as will be described below.

Preferably, the oral care fluid comprises one or more oral care agents. Any suitable oral care agent(s) can be used in the present invention. In the illustrated embodiment, the oral care fluid is a mouthwash comprising one or more antibacterial agents, flavors or flavor ingredients, and breath freshening ingredients. However, in variations to the illustrated embodiment, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In some embodiments, the oral care fluid comprises more than one of the oral care agents listed in the preceding sentence. The oral care fluid preferably is free of (i.e., is not) toothpaste. Preferably, the oral care fluid is intended to provide supplemental oral care benefits in addition to merely brushing one's teeth. The oral care fluid may be for enhancing the performance of dentifrice, to provide synergistic benefits.

With continuing reference to FIG. 2, the fluid outlet 125 is an outlet through which the oral care fluid is dispensable to an exterior of the toothbrush 1. The cavity 400, and more specifically the first reservoir 401, is fluidly connected to the fluid outlet 125 by a passageway 330. Thus, the passageway 330 extends from the cavity 400 in the handle 110, through the neck portion 118 of the handle 110, to the fluid outlet 125 of the head 120. In the illustrated embodiment, the passageway 330 is defined by material of the body 100. In variations to the illustrated embodiment, some or a majority of the passageway 330 may be defined by a separate, preferably flexible, tube that extends through the body 100. The fluid outlet 125 may be of any form known in the art. The fluid outlet 125 may permanently permit fluid communication from the exterior of the toothbrush 1 to the passageway 330, or the fluid outlet 125 may comprise a valve, such as a check valve, that permits fluid flow from the passageway 330 to the exterior of the toothbrush 1 and restricts or prevents fluid flow from the exterior of the toothbrush 1 to the passageway 330. Optionally, the fluid outlet 125 includes a spray or atomizer nozzle for causing the oral care fluid to be emitted as one of a spray, a mist, and a stream. Such a nozzle optionally causes the oral care fluid to be emitted in the form of droplets having an average diameter of less than 500 microns, or less than 400 microns, or less than 300 microns, or less than 200 microns, or less than 150 microns.

The toothbrush 1 further comprises the control valve 300 in the handle 110. The control valve 300 is movable between a first position for preventing fluid flow from the first reservoir 401 through the fluid outlet 125 and a second position for permitting fluid flow from the first reservoir 401 through the fluid outlet 125. In FIG. 2, the control valve 300 is shown at the first position, at which the control valve 300 blocks the passageway 330, thereby to prevent fluid flow from the first reservoir 401 through the fluid outlet 125. In the illustrated embodiment, the control valve 300 is a plunger valve, but in variations to the illustrated embodiment, the control valve 300 may be a pinch valve or any other type of valve that is movable between such first and second positions to control fluid flow from the first reservoir 401 through the fluid outlet 125.

The user-operable valve actuator 310 of the control valve 300 comprises the thumb grip surface 311, mentioned above, on the front side 113 of the handle 110. The control valve 300 is movable by a user from the first position to the second position by the user applying a force to the thumb grip surface 311 in a direction towards a longitudinal axis A-A of the toothbrush 1 sufficient to move the valve actuator 310 towards the longitudinal axis A-A of the toothbrush 1. The toothbrush 1 further comprises a biasing device 320, in the form of a helical spring in the illustrated embodiment, between the valve actuator 310 and material of the body 100. The biasing device 320 biases the control valve 300 towards the first position so that, when the user removes or reduces the force applied to the thumb grip surface 311, the biasing device 320 biases the valve actuator 310 away from the longitudinal axis A-A of the toothbrush 1, thereby to return the control valve 300 to the first position.

Downstream of the control valve 300, i.e. between the control valve 300 and the fluid outlet 125, the toothbrush 1 comprises a check valve 340 (herein referred to as the "third check valve", for ease of reference only) in the passageway 330 for permitting fluid flow from the first reservoir 401 towards the fluid outlet 125 and for restricting or preventing fluid flow from the fluid outlet 125 towards the first reservoir 401. The third check valve 340 helps avoid salvia and used dentifrice migrating from the oral care elements 200 to the control valve 300 and the first reservoir 401. In a variation to the illustrated embodiment, the third check valve 340 is upstream of the control valve 300, i.e. between the first reservoir 401 and the control valve 300. In a further variation to the illustrated embodiment, the third check valve 340 is omitted.

At the proximal end 111 of the handle 110, and indeed the proximal end 101 of the body 100, the toothbrush 1 comprises the pump 500. The pump 500 is for pushing air into the second reservoir 402 from the exterior of the toothbrush 1. More specifically, the toothbrush 1 comprises a first opening 420 fluidly connecting the second reservoir 402 with the exterior of the toothbrush 1 via the pump 500. Since the overall cavity 400 is of a fixed volume, such pushing of air into the second reservoir 402 causes pressurization of the second reservoir 402 and, in turn, pressurization of the first reservoir 401 and the oral care fluid therein.

The pump 500 comprises a pump actuator 510 movably attached to the handle 110. The pump actuator 510 forms the proximal end 11 of the toothbrush 1. The handle 110 and the pump actuator 510 define therebetween a chamber 530 of the pump 500. Since the pump actuator 510 is movably attached to the handle 110, the chamber 530 is of variable volume. That is, as the pump actuator 510 is moved towards the handle 110, the volume of the chamber 530 is reduced. In a variation to the illustrated embodiment, the toothbrush 1 includes a biasing device, such as a helical spring, between the pump actuator 510 and the handle 110 for biasing the pump actuator 510 away from the handle 110.

In the illustrated embodiment, the pump actuator 510 is substantially rigid. In a variation to the illustrated embodiment, the pump actuator 510 comprises flexible material, such as an elastomer or an elastomeric material, defining the chamber 530. In such a variation, the volume of the chamber 530 is reducible by compressing or otherwise deforming the pump actuator 510.

The pump actuator 510 also defines a second opening 520 fluidly connecting the chamber 530 with the exterior of the toothbrush 1. The chamber 530 is fluidly connected with the second reservoir 402 via the first opening 420. Thus, the second reservoir 402 is fluidly connected with the exterior of the toothbrush 1 via the first opening 420, the chamber 530, and the second opening 520, in that order. The pump 500 further comprises a check valve 511 (herein referred to as the "first check valve", for ease of reference only) in the first opening 420 for permitting air flow into the second reservoir 402 from the exterior of the toothbrush 1 via the first opening 420 and for restricting or preventing air flow from the second reservoir 402 to the exterior of the toothbrush 1 via the first opening 420. In variations to the illustrated embodiment, the first check valve 511 may be fixed to an inner wall of the second reservoir 402, or to an inner wall of the chamber 530, over the first opening 420, and thus may not be considered to be in the first opening 420. The pump further comprises a check valve 512 (herein referred to as the "second check valve", for ease of reference only) in the second opening 520 for permitting air flow into the chamber 530 from the exterior of the toothbrush 1 via the second opening 520 and for restricting or preventing air flow from the chamber 530 to the exterior of the toothbrush 1 via the second opening 520. In variations to the illustrated embodiment, the second check valve 512 may be fixed to an outer wall of the pump actuator 510, or to an inner wall of the chamber 530, over the second opening 520, and thus may not be considered to be in the second opening 520. The pump 500 is operable to reduce the volume of the chamber 530 when the second opening 520 is blocked, e.g. by the second check valve 512, thereby to push air from the chamber 530 into the second reservoir 402 via the first opening 420.

Operation of the illustrated toothbrush 1 will now be described. While maintaining the control valve 300 at the first position, and preferably prior to brushing their teeth, a user moves the pump actuator 510 towards the handle 110, thereby to reduce the volume of the chamber 530. During this movement, the second check valve 512 prevents air leaving the chamber 530 via the second opening 520, and the first check valve 511 permits air to pass from the chamber 530 to the second reservoir 402 via the first opening 420, thereby increasing the pressure of air present in the second reservoir 402. The increased pressure of the air in the second reservoir 402 causes the air in the second reservoir 402 to apply a force to the piston 410. This application of force to the piston 410 pushes the oral care fluid in the first reservoir 401 towards the control valve 300, and increases the pressure of the oral care fluid in the first reservoir 401 until the pressures in the first and second reservoirs 401, 402 are substantially equal. When the user subsequently moves the pump actuator 510 away from the handle 110, the chamber 530 expands, the second check valve 512 permits air to enter the chamber 530 via the second opening 520, and the first check valve 511 prevents air returning from the second reservoir 402 into the chamber 530 via the first opening 420. Repeated such movements of the pump actuator 510 towards, and then away from, the handle 110 while the control valve 300 is at the first position further increases the pressure of the oral care fluid in the first reservoir 401. That is, the oral care fluid in the first reservoir 401 becomes "pre-pressurized".

Preferably, the user next applies a dentifrice to the oral care elements 200 and then uses the dentifrice and the oral care elements 200 to brush their teeth. When the user wishes to dispense some of the oral care fluid into their oral cavity in order to benefit from the effects of the oral care fluid, while holding the head 120 in their oral cavity, the user applies a force onto the thumb grip surface 311 in a direction towards the longitudinal axis A-A of the toothbrush 1 sufficient to move the valve actuator 310 towards the longitudinal axis A-A of the toothbrush 1. As discussed above, this action moves the control valve 300 to the second position, at which fluid flow from the first reservoir 401 through the fluid outlet 125 is permitted. Since the oral care fluid in the first reservoir 401 has been pre-pressurized, when the control valve 300 is moved to the second position, an appreciable volume of the oral care fluid flows out of the toothbrush 1 through the fluid outlet 125 via the passageway 330. The user may then remove or reduce the force applied to the thumb grip surface 311, to permit the biasing device 320 to move the valve actuator 310 away from the longitudinal axis A-A of the toothbrush 1, thereby to return the control valve 300 to the first position. Of course, a user may choose to dispense the oral care fluid before, during or after brushing their teeth.

Figure 3:
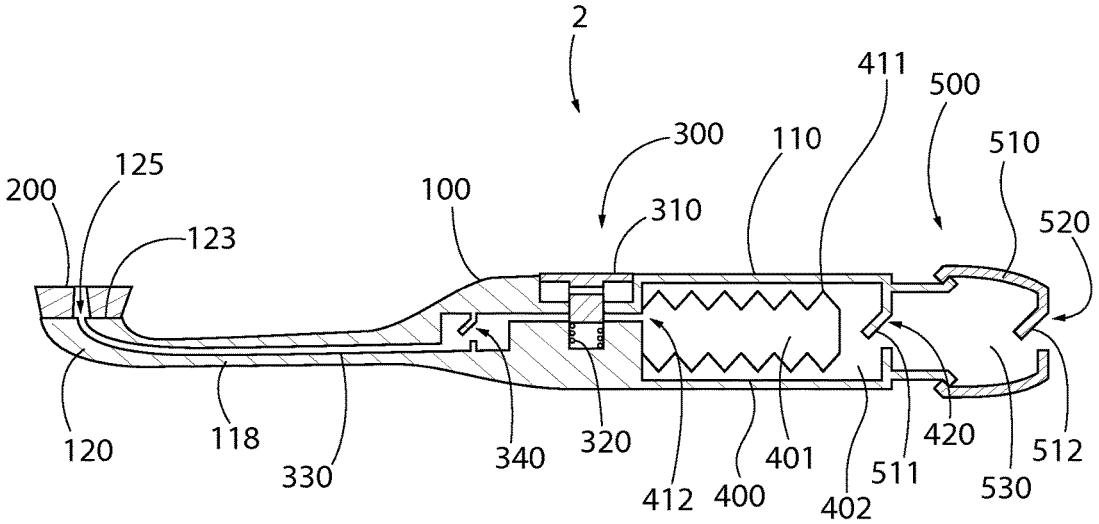
FIG. 3 shows a schematic diagram of an oral care implement according to another exemplary embodiment of the present invention.

FIG. 3 illustrates an oral care implement, in this case a toothbrush, according to another exemplary embodiment of the present invention, generally designated with the reference numeral 2. Like reference numerals used in FIG. 3 and FIG. 2 indicate like components. The oral care implement 2 of FIG. 3 shares many features with the oral care implement 1 of FIGS. 1 and 2, and differs only in the form of the movable wall in the cavity 400. The exterior of the oral care implement 2 of FIG. 3 is the same as that shown in FIG. 1.

In the oral care implement 2 of FIG. 3, the movable wall comprises a deformable vessel 411 surrounding the first reservoir 401, and the vessel 411 has an orifice 412 in fluid communication with the passageway 330. The vessel 411 is deformable according to a predetermined pattern of collapse and comprises a bellows. In a variation to the illustrated embodiment, the vessel 411 may be a bag or other vessel that is deformable according to an unpredictable pattern of collapse. As will be appreciated from FIG. 3, a portion of the second reservoir 402 surrounds the first reservoir 401.

From a user's perspective, the oral care implement 2 of FIG. 3 is usable in the same way as the oral care implement 1 of FIGS. 1 and 2 to pre-pressurize the oral care fluid in the first reservoir 401, and to then dispense some of the oral care fluid into their oral cavity in order to benefit from the effects of the oral care fluid.

Figure 4:
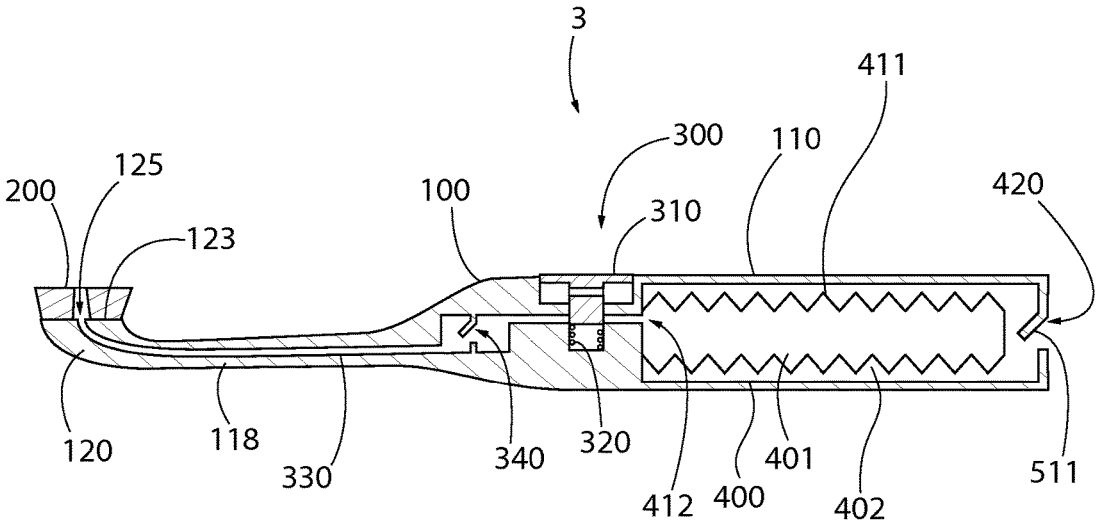
FIG. 4 shows a schematic diagram of an oral care implement according to a further exemplary embodiment of the present invention.

FIG. 4 illustrates an oral care implement, in this case a toothbrush, according to a further exemplary embodiment of the present invention, generally designated with the reference numeral 3. Like reference numerals used in FIG. 3 and FIG. 2 indicate like components. The oral care implement 3 of FIG. 4 shares many features with the oral care implement 2 of FIG. 3. However, the pump actuator 510 is omitted from the oral care implement 3 of FIG. 4 and the cavity 400 is of variable, rather than fixed, volume. More specifically, in the oral care implement 3 of FIG. 4, the handle 110 defines the cavity 400, is resilient (i.e. is made of a resilient material(s)), and is compressible to reduce the volume of the cavity 400.

In order to operate the toothbrush 3 of FIG. 4, while maintaining the control valve 300 at the first position, and preferably prior to brushing their teeth, a user applies a force to the handle 110 to squeeze or compress the handle 110 in their hand, thereby to reduce the volume of the cavity 400. More specifically, the compression of the handle 110 causes a reduction in the volume of the second reservoir 402. Since the first check valve 511 prevents air leaving the second reservoir 402 via the first opening 420, such reduction in the volume of the second reservoir 402 increases the pressure of the air present in the second reservoir 402. The increased pressure of the air in the second reservoir 402 causes the air in the second reservoir 402 to apply a force to the vessel 411. This application of force to the vessel 411 pushes the oral care fluid in the first reservoir 401 towards the control valve 300, and increases the pressure of the oral care fluid in the first reservoir 401 until the pressures in the first and second reservoirs 401, 402 are substantially equal. When the user subsequently reduces or removes the force applied to the handle 110, the inherent resiliency of the material of the handle 110 causes the handle to expand towards its original, uncompressed state, during which the first check valve 511 permits air to enter the second reservoir 402 via the first opening 420. Repeated such compressions and subsequent relaxations of the handle 110 while the control valve 300 is at the first position further increases the pressure of the oral care fluid in the first reservoir 401. That is, the oral care fluid in the first reservoir 401 becomes "pre-pressurized".

Preferably, the user next applies a dentifrice to the oral care elements 200 and then uses the dentifrice and the oral care elements 200 to brush their teeth. When the user wishes to dispense some of the oral care fluid into their oral cavity in order to benefit from the effects of the oral care fluid, while holding the head 120 in their oral cavity, the user applies a force onto the thumb grip surface 311 in a direction towards the longitudinal axis A-A of the toothbrush 3 sufficient to move the valve actuator 310 towards the longitudinal axis A-A of the toothbrush 3. As discussed previously in relation to the toothbrush 1 of FIGS. 1 and 2, this action moves the control valve 300 to the second position, at which fluid flow from the first reservoir 401 through the fluid outlet 125 is permitted. Since the oral care fluid in the first reservoir 401 has been pre-pressurized, when the control valve 300 is moved to the second position, an appreciable volume of the oral care fluid flows out of the toothbrush 3 through the fluid outlet 125 via the passageway 330. The user may then remove or reduce the force applied to the thumb grip surface 311, to permit the biasing device 320 to move the valve actuator 310 away from the longitudinal axis A-A of the toothbrush 3, thereby to return the control valve 300 to the first position. Again, a user may choose to dispense the oral care fluid before, during or after brushing their teeth.

In each of the illustrated embodiments, since the user need only move the valve actuator 310 once in order to dispense an appreciable volume of oral care fluid, the mechanism provided for dispensing the oral care fluid is less tiresome and uncomfortable for the user to operate during dispensing.

In variations to the illustrated embodiments, the cavity 400 may be provided elsewhere in the body 100 than at the position shown in the Figures. For example, the cavity 400 may be provided in or adjacent to the neck portion 118 of the handle 110, or in the head 120 of the body 100. In some variations to the illustrated embodiment, the cavity 400 may extend into both the handle 110 and the head 120 of the body 100.

In variations to the illustrated embodiments, the fluid outlet 125 may be provided in the handle 100, such as in the neck portion 118 of the handle 110 or at the proximal end 111 of the handle 110.

In variations to the embodiments illustrated in FIGS. 1 to 3, the second check valve 512 is omitted. In such variations, the pump 500 still is operable to reduce the volume of the chamber 530 when the second opening 520 is blocked by a user's finger or thumb, thereby to push air from the chamber 530 into the second reservoir 402 via the first opening 420.

In variations to the embodiments illustrated in FIGS. 1 to 3, the pump 500 may be provided elsewhere in the toothbrushes 1, 2 than at the position shown in the Figures. For example, the pump 500 may be provided in or adjacent to the neck portion 118 of the handle 110, adjacent the thumb grip surface 311 of the user-operable valve actuator 310, or in the head 120 of the body 100.

What is claimed is:

1. An oral care implement, comprising:

a body comprising a handle and a head at an end of the handle, the body having a cavity therein, and the head having at least one oral care element extending therefrom;

a movable wall in the cavity, the wall dividing the cavity into first and second reservoirs of variable volume, the first reservoir storing an oral care fluid;

a fluid outlet through which the oral care fluid is dispensable to an exterior of the oral care implement;

a passageway fluidly connecting the first reservoir with the fluid outlet;

a control valve movable between a first position for preventing fluid flow from the first reservoir through the fluid outlet and a second position for permitting fluid flow from the first reservoir through the fluid outlet, the control valve comprising a user-operable valve actuator and a thumb grip surface;

a first opening fluidly connecting the second reservoir with the exterior of the oral care implement; and a first check valve for permitting air flow into the second reservoir from the exterior of the oral care implement via the first opening and for restricting air flow from the second reservoir to the exterior of the oral care implement via the first opening;

wherein a force applied to the thumb grip surface moves the control valve from the first position to the second position.

2. The oral care implement of claim 1, wherein the wall comprises a piston.

3. The oral care implement of claim 1, wherein the wall comprises a deformable vessel surrounding the first reservoir, and wherein the vessel has an orifice in fluid communication with the passageway.

4. The oral care implement of claim 3, wherein at least a portion of the second reservoir surrounds the first reservoir.

5. The oral care implement of claim 1, comprising a pump comprising a chamber and a second opening fluidly connecting the chamber with the exterior of the oral care implement, wherein the chamber is fluidly connected with the second reservoir via the first opening.

6. The oral care implement of claim 5, wherein the chamber is of variable volume, and the pump is operable to reduce the volume of the chamber when the second opening is blocked, thereby to push air from the chamber into the second reservoir via the first opening.

7. The oral care implement of claim 6, wherein the pump comprises flexible material defining the chamber.

8. The oral care implement of claim 5, wherein the pump comprises a second check valve for permitting air flow into the chamber from the exterior of the oral care implement via the second opening and for restricting air flow from the chamber to the exterior of the oral care implement via the second opening.

9. The oral care implement of claim 8, comprising a third check valve in the passageway for permitting fluid flow from the first reservoir towards the fluid outlet and for restricting fluid flow from the fluid outlet towards the first reservoir.

10. The oral care implement of claim 5, wherein the pump is at an opposite end of the handle from the head.

11. The oral care implement of claim 1, wherein the head defines the fluid outlet.

12. The oral care implement of claim 1, wherein the cavity is of fixed volume.

13. The oral care implement of claim 1, wherein the cavity is of variable volume.

14. The oral care implement of claim 13, wherein the handle defines the cavity and is compressible to reduce the volume of the cavity.

15. The oral care implement of claim 1, wherein the control valve is in the handle.

16. The oral care implement of claim 1, wherein, when the control valve is at the first position, the control valve blocks the passageway.

17. The oral care implement of claim 1, comprising a biasing device that biases the control valve towards the first position.

18. The oral care implement of claim 1, wherein the oral care fluid is stored in the first reservoir.

19. The oral care implement of claim 1, wherein the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents;

colorants or aesthetic ingredients; and combinations thereof.

20. The oral care implement of claim 1, wherein the oral care implement comprises a toothbrush.

* * * * *